United States Patent [19]

Williams

[11] 4,407,560

[45] Oct. 4, 1983

[54] ELECTRICAL ADAPTER

[76] Inventor: Michael Williams, R.D. #3 Box 222, Quakertown, Pa. 18951

[21] Appl. No.: 277,127

[22] Filed: Jun. 25, 1981

[51] Int. Cl.[3] ..... H01R 13/504

[52] U.S. Cl. ..... 339/154 L

[58] Field of Search ..... 339/154 L

[56] References Cited

U.S. PATENT DOCUMENTS

| | | | |
|---|---|---|---|
| 2,127,124 | 8/1938 | Litner | 339/154 L X |
| 2,385,478 | 9/1945 | Steinmayer | 339/154 L |
| 3,248,534 | 4/1966 | Cahill et al. | 339/154 L X |

*Primary Examiner*—Eugene F. Desmond

*Attorney, Agent, or Firm*—Ronald G. Goebel

[57] ABSTRACT

An electrical adapter is described particularly useful for converting a 250 watt halogen lamp socket having a width of 7/16" to a 75 watt episical reflector lamp or flood socket having a diameter of 1". The adapter comprises a top and bottom hollow ceramic section. The top section consists of a hollow base member adhesively mated to a top member. The top member has mounted thereon a male screw shell and a center contact. The bottom ceramic section contains an internally threaded female screw shell and a bottom central contact. A connecting member is bonded to the hollow base member of the top section and is equipped with a central internally threaded collar to which is threaded a tubular neck. The bottom section is screwed to the connecting member. Wires connect the top and bottom center contacts and the male and female screw shells.

9 Claims, 3 Drawing Figures

ELECTRICAL ADAPTER

BACKGROUND OF THE INVENTION

This invention relates to electric lamp adapters for converting an electrical lamp socket of one size to a larger socket size, particularly for converting a 250 watt halogen lamp socket having an inner diameter of 7/16" to a 75 watt elipsical reflector lamp or flood socket having a diameter of 1".

In the past there have been many electric lamp adapters described in the art which accomplish one or more specific objectives such as heat dissipation, extending the space between the receptacle and light center, changing the angle of the socket or for converting one socket size to another size.

The present invention provides an electrical adapter for converting one socket size to a larger socket size which is safe, efficient and compact in design and construction.

SUMMARY OF THE INVENTION

The present invention provides an adapter for converting an electrical lamp socket of one size to a larger socket size. The adapter comprises a top and a bottom ceramic section, each being hollow. The top section consists of a hollow base member adhesively mated to a top member through upwardly extending protrusions on the bottom section and corresponding notches on the top member. The top member has mounted thereon a male screw shell and a center electrical contact fitable into a socket of standard size, e.g. 7/16"-250 watt halogen lamp socket. The bottom ceramic section contains an internally threaded female screw shell and a bottom central contact. A standard size lamp e.g. a flood lamp may be threaded into the female screw shell. A connecting member is bonded to the hollow base member of the top section. The connecting member is equipped with a central internally threaded collar to which is threaded a tubular neck. The connecting member also has downwardly extending internally-threaded tubular sections for receiving screws therein. An insulating sealing member is nested between the bottom ceramic section and connecting member. The sections are fastened by screws passing through the bottom section, sealing member and threaded into the internally threaded tubular sections of the connecting member. An insulated wire connects the top and bottom center contacts and passes through the neck and collar and an insulated wire connects the top male screw shell and bottom female screw shell.

DETAILED DESCRIPTION OF THE PREFERRED EMBODIMENTS

Figure 1:
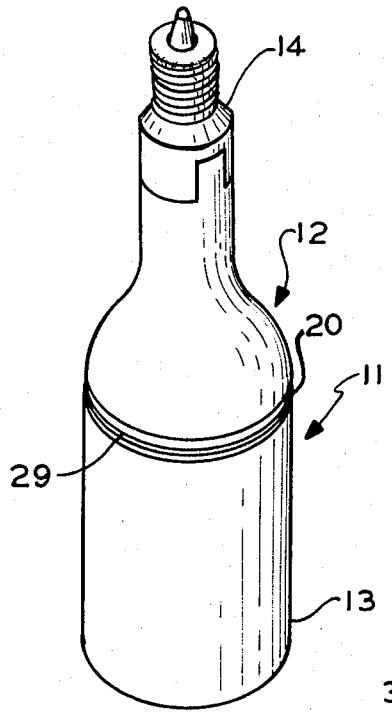
FIG. 1 shows a perspective side view of the adapter of this invention.
Figure 2:
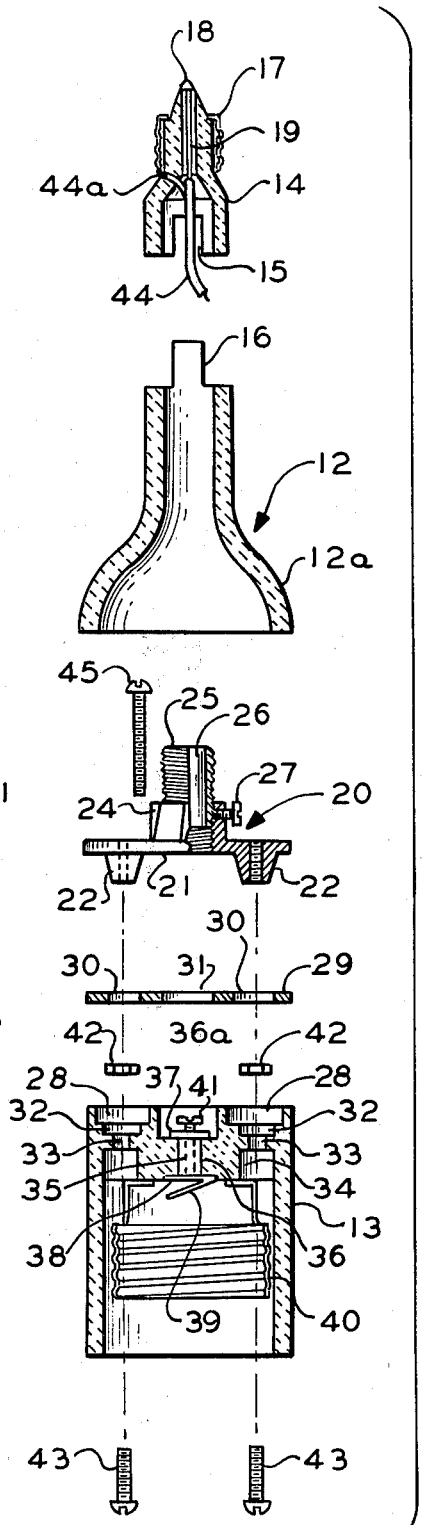
FIG. 2 is an exploded view of the adapter showing the assembly of all major components.
Figure 3:
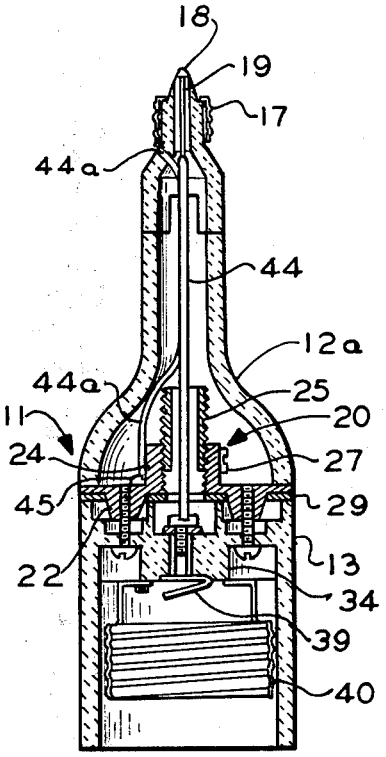
FIG. 3 is a sectional side view of an assembled adapter.

Referring to the figures, a lamp adapter is shown for coverting a socket of one given size to a larger size socket, and particularly for converting a 250 watt halogen lamp socket having a diameter of 7/16" to a 75 watt elipsical reflector lamp or flood socket having a diameter of 1".

The adapter is indicated generally by 11 and comprises a top section 12 and bottom section 13, each comprised of a ceramic material such as porcelain or the like. The upper ceramic section 12 consists of a hollow bell-shaped base member **12*a* and a hollow top member 14. The hollow top member 14 contains a pair of opposed rectangular notches 15 (only one shown) which mate with upwardly extending rectangular protrusions 16 on base member 12*a*. Adhesive is applied to the joints of these notches and extensions to bond the top and base members together. The top member has located thereon male screw shell 17 and top center contact 18 which are fitable into a socket having a female screw shell corresponding in size to the male screw shell 17. Pin 19 extends downwardly from contact 18 into the larger, hollow space of the top member. Adhesively mounted at the lower end of the base member 12*a* is connecting member 20 consisting of transverse section 21 having extending downwardly therefrom and integral therewith internally threaded tubular sections 22. Centrally on the top surface of the transverse section 21 is internally threaded collar 24. Threaded partially into said collar 24 inside the hollow portion of ceramic base member 12*a* is externally threaded neck member 25 having a tubular aperture 26 extending therethrough. The neck 25 is restricted from being threaded too far into the collar by set screw 27**.

A spacer 29 made of an insulating material having end holes 30 and central hole 31 abuts against the lower surface of transverse member 21, end holes 30 accomodating the passing through of tubular sections 22. Hollow lower section 13 has recessed in its top portion, large end recesses 28, washer recesses 32 and screw holes 33. The hollow lower section 13 contains a central support section 34 having a central bore 35 through which metal sleeve 36 extends. An upper central recess **36*a* is located at the top of the support section. The sleeve 36 has upper collar 37 which rests on the support section and terminates at the lower surface of the central support section with lower collar 38 having tabular contact 39 resiliently extending therefrom. Female threaded screw shell 40 extends from the lower portion of central support section 34. Screw 41 is threaded into sleeve 36 in the central bore 35. Washers 42 fit into washer recesses 32. A screw 45 extends through the connecting member 20, spacer 29 and central support section 34 into the top section of the metal screw shell. A pair of wires 44 and 44*a* are connected at each one of their ends to top contact pin 19 and male screw shell 17, respectively, wire 44 is fed through neck 25, collar 24, central hole 31 and then connected to screw 41 which in turn is connected with sleeve 36 and center tab contact 39. Wire 44*a* is connected with screw 45. When bottom section 13 containing washers 42 is raised up into section 12*a*, connecting member 22 and spacer 29, end recesses 28 accomodate tubular extensions 22 and recess 31 registers with central bore 36*a*. Screws 43 are placed in screw holes 32, through washers 42 and into the threaded apertures of the tubular extensions 22**.

I claim:

1. An adapter comprising:

(a) a top section comprised of a hollow ceramic base member having upwardly extending protrusions and a hollow ceramic top member having notched portions corresponding to said protrusions, said upwardly extending protrusions engaging said notched portions to form joints, said joints being secured by an adhesive (b) a male threaded screw shell and a central contact mounted on said top member; and (c) a bottom ceramic section connected with said base member having mounted thereon an internally threaded female screw shell and a central contact, said central contact mounted on said top member and said central contact mounted on said bottom ceramic section being electrically connected and said male threaded screw shell and said female threaded screw shell being electrically connected.

2. The adapter of claim 1 wherein said adapter further comprises:

a connecting member bonded to said hollow ceramic base, said connecting member having a central internally threaded collar.

3. The adapter of claim 2 wherein a neck is threadably engaged with said collar.

4. The adapter of claim 1 which further comprises a spacer comprised of insulating material between said hollow ceramic base and said bottom ceramic section.

5. An adapter comprising:

(a) a top section comprised of a hollow ceramic base member having upwardly extending protrusions and a hollow ceramic top member having notched portions corresponding to said protrusions, said upwardly extending protrusions engaging said notched portions to form joints, said joints being secured by an adhesive;

(b) a male theaded screw shell and a top central contact mounted on said top member;

(c) a connecting member bonded to said hollow ceramic base member having a central internally threaded collar;

(d) a tubular neck threadably engaging said threaded collar;

(e) a bottom ceramic section connected to said connecting member having mounted thereon an internally threaded female screw shell and a bottom central contact; and (f) a pair of wires, one being connected at one end to said top central contact, passing through said tubular neck and central collar and connected at its other end to said bottom central contact and the other of said wires being connected at one end to said male threaded screw shell and at the other end with said female threaded screw shell.

6. The adapter of claim 5 which further comprises a spacer comprised of insulating material between said hollow ceramic base and said bottom ceramic section.

7. The adapter of claim 5 wherein said male threaded screw shell is 7/16" in diameter.

8. The adapter of claim 5 wherein said female threaded screw shell is 1" in diameter.

9. An adapter comprising:

(a) a top section comprised of a hollow ceramic base member having upwardly extending protrusions and a hollow ceramic top member having notched portions corresponding to said protrusions, said upwardly extending protrusions engaging said notched portions to form joints, said joints being secured by an adhesive;

(b) a male threaded screw shell having a diameter of 7/16" and a top central contact mounted on said top member;

(c) a connecting member bonded to said hollow ceramic base member having a central internally threaded collar;

(d) a tubular neck threadably engaging said threaded collar;

(e) a spacer comprised of insulating material located beneath said connecting member;

(f) a bottom ceramic section connected to said connecting member having mounted thereon an internally threaded female screw shell having an inner diameter of 1" and a bottom central contact; and (g) a pair of wires, one being connected at one end to said top central contact, passing through said tubular neck and central collar and connected at its other end to said bottom central contact and the other of said wires being connected at one end to said male threaded screw shell and at the other end with said female threaded screw shell.

* * * * *